US007982674B2

(12) United States Patent
Yang et al.

(10) Patent No.: US 7,982,674 B2
(45) Date of Patent: Jul. 19, 2011

(54) DUAL-BAND ANTENNA

(75) Inventors: Wen-Chieh Yang, Tu-Cheng (TW); Kai Shih, Tu-Cheng (TW); Yu-Yuan Wu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 347 days.

(21) Appl. No.: 12/350,397

(22) Filed: Jan. 8, 2009

(65) Prior Publication Data

US 2010/0171664 A1 Jul. 8, 2010

(51) Int. Cl.
*H01Q 1/38* (2006.01)

(52) U.S. Cl. ..... 343/700 MS; 343/702; 343/829; 343/846

(58) Field of Classification Search ..... 343/700 MS, 343/702, 829, 846
See application file for complete search history.

(56) References Cited

U.S. PATENT DOCUMENTS 6,982,675 B2 * 1/2006 Kwak et al. ..... 343/702
7,034,754 B2 * 4/2006 Hung et al. ..... 343/700 MS
7,342,540 B2 * 3/2008 Nahar et al. ..... 343/702
7,450,076 B1 * 11/2008 Lin et al. ..... 343/702
7,633,448 B2 * 12/2009 Su et al. ..... 343/702
2008/0007461 A1 * 1/2008 Su et al. ..... 343/700 MS
2008/0094293 A1 * 4/2008 Chang et al. ..... 343/702
2008/0252533 A1 * 10/2008 Hung et al. ..... 343/700 MS

* cited by examiner

*Primary Examiner* — Douglas W Owens
*Assistant Examiner* — Chuc D Tran
(74) *Attorney, Agent, or Firm* — Muncy, Geissler, Olds & Lowe, PLLC

(57) ABSTRACT

A dual-band antenna has a feeding portion including a first feeding portion and a second feeding portion extending perpendicularly from a top of the first feeding portion. A first high-frequency portion spaced away from the second feeding portion extends upwards from the first feeding portion, and a second high-frequency portion extends perpendicularly from the first high-frequency portion and located at a same side with respect to the first feeding portion as the second feeding portion. A first low-frequency portion located at a same side with respect to the first feeding portion as the second high-frequency portion extends perpendicularly from an end of the first feeding portion. A second low-frequency portion extends upwards from the first low-frequency portion. A third low-frequency portion extends back to the first low-frequency portion from the second low-frequency portion. A grounding portion connected with the feeding portion by a connecting portion faces the low-frequency radiator.

6 Claims, 2 Drawing Sheets

DUAL-BAND ANTENNA

BACKGROUND OF THE INVENTION

1. Field of the Invention

This present invention relates to an antenna, and more specifically to a dual-band antenna mainly applied in a notebook computer.

2. The Related Art

Portable electronic devices, such as notebook computers, are usually equipped with antennas for wirelessly transmitting information. In general, there are two types of the antennas mainly used in the notebook computers, planar inverted-F antennas and monopole antennas. However, since the frequency band, antenna gain and radiating efficiency of the planar inverted-F antenna are all in direct proportion to the volume of the planar inverted-F antenna, a dual-band antenna made up of the planar inverted-F antennas is tend to have narrower frequency bands under the condition of miniaturization and complanation, partly covering the frequency bands of 5.2~5.8 giga-hertz (GHz) and 2.4~2.5 GHz accordant with the standard of IEEE802.11a/b in wireless local area network (WLAN). Therefore, the planar inverted-F antennas cannot meet the present demands of users. The monopole antenna, though, has a broad frequency band, it has to provide a bigger grounding portion for being in use. So the wide spread use of the monopole antenna is meanwhile limited because of the small available space of the notebook computers.

SUMMARY OF THE INVENTION

An object of the invention is to provide a dual-band antenna used in a notebook computer having a broad frequency band with a small occupied space. The dual-band antenna has a feeding portion including a first feeding portion and a second feeding portion extending substantially perpendicularly from a top edge of the first feeding portion. A high-frequency radiator spaced away from the second feeding portion includes a first high-frequency portion extending upwards from the top edge of the first feeding portion, and a second high-frequency portion extending substantially perpendicularly from a top of the first high-frequency portion and located at a same side with respect to the first feeding portion as the second feeding portion. A low-frequency radiator located at a same side with respect to the first feeding portion as the second high-frequency portion includes a first low-frequency portion extending substantially perpendicularly from an end of the first feeding portion adjacent to the high-frequency radiator, a second low-frequency portion extending upwards from the first low-frequency portion, and a third low-frequency portion extending back to the first low-frequency portion from the second low-frequency portion. A grounding portion faces the low-frequency radiator for substantially locating the feeding portion and the high-frequency radiator therebetween. A connecting portion connects the grounding portion and the feeding portion.

As described above, the dual-band antenna has both the high-frequency radiator and the low-frequency radiator for receiving and transmitting signals ranging from 5.2~5.8 GHz and 2.4~2.5 GHz. Meanwhile, the grounding portion faces the low-frequency radiator, and the feeding portion and the high-frequency radiator are substantially disposed between the grounding portion and the low-frequency radiator. Thus, the dual-band antenna occupies a small space of the notebook computer.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE EMBODIMENT

Figure 1:
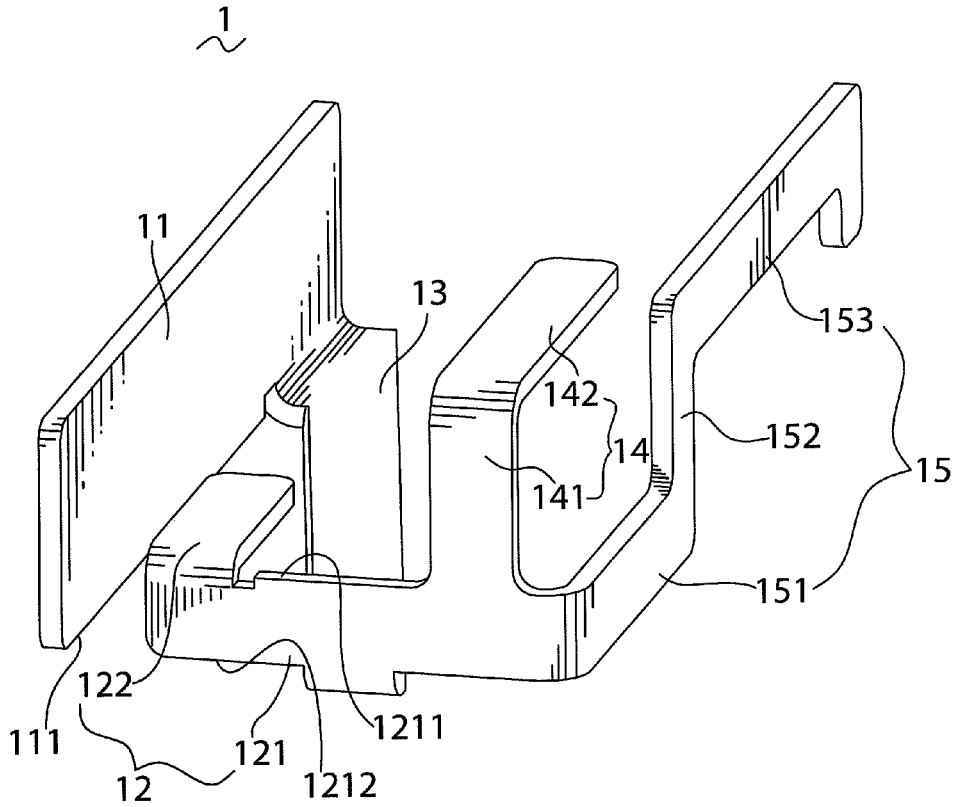
FIG. 1 shows a perspective view of a dual-band antenna in accordance with an embodiment of the present invention.
Figure 2:
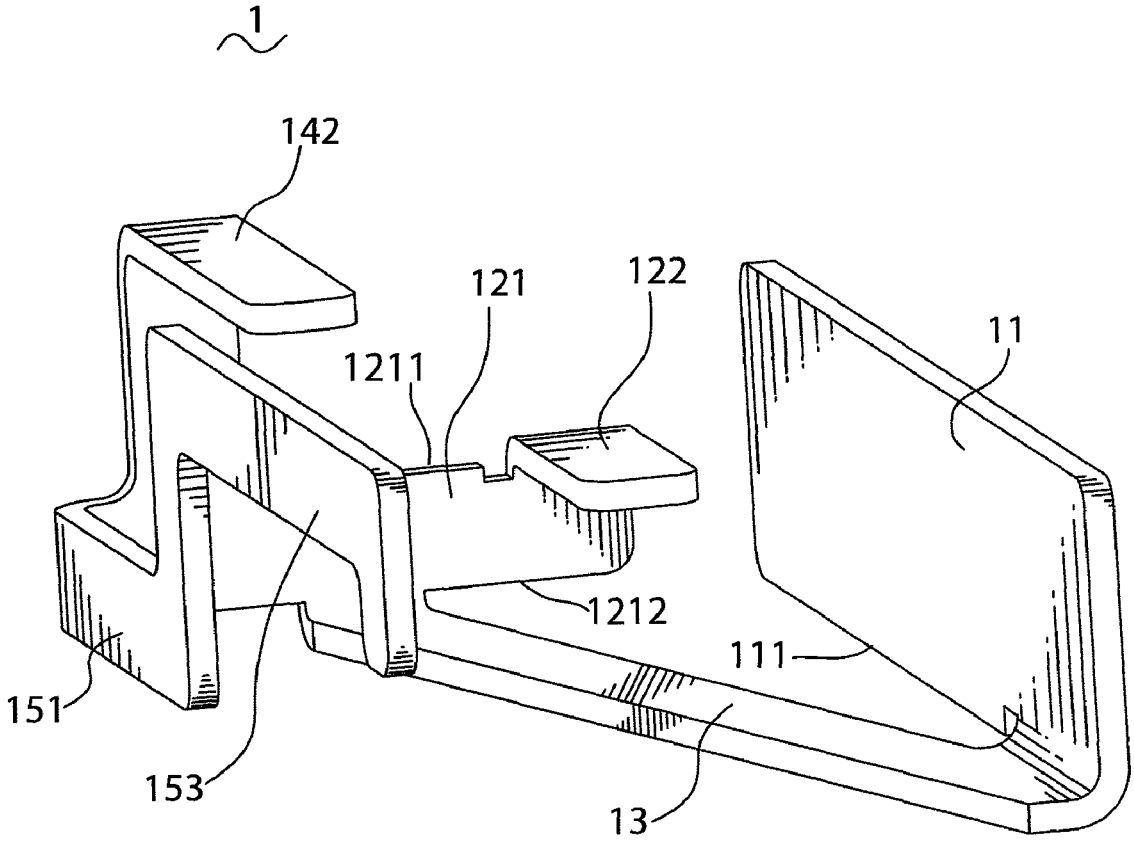
FIG. 2 shows a perspective view of the dual-band antenna in FIG. 1 seen from another angle.

With Reference to FIG. 1 and FIG. 2, a dual-band antenna 1 of an embodiment according to the present invention mounted in a notebook computer (not shown) for receiving and transmitting signals is shown. The dual-band antenna 1 has a grounding portion 11 of rectangular-board shape. An end of a bottom edge 111 of the grounding portion 11 is extended obliquely to form connecting portion 13 of strip shape. The connecting portion 13 is disposed levelly and forms a sharp angle with the grounding portion 11. In this embodiment, the angle is about 45.degree. A free end of the connecting portion 13 is connected with a feeding portion 12 including a first feeding portion 121 and a second feeding portion 122. The first feeding portion 121 of a strip shape, extending along a direction perpendicular to the grounding portion 11, is substantially flush with an edge of the grounding portion 11 away from the connecting portion 13, with a predetermined distance formed therebetween. Herein, the connecting portion 13 is joined to a middle portion of the bottom edge 1212 of the first feeding portion 121. One end of the top edge 1211 of the first feeding portion 121 extends perpendicularly to form a second feeding portion 122 near the grounding portion 11. The second feeding portion 122 is rectangular and located at a same side with respect to the first feeding portion 121 as the connecting portion 13.

The other end of the top edge 1211 of the first feeding portion 121 is extended upwards to form a first high-frequency portion 141. The first high-frequency portion 141 is a rectangular shape. A free end of the first high-frequency portion 141 extends perpendicular to the first high-frequency portion 141 to form a second high-frequency portion 142 located at a same side with respect to the first feeding portion 121 as the second feeding portion 122. The second high-frequency portion 142 has a length substantially equivalent to that of the first high-frequency portion 141. The first high-frequency portion 141 and the second high-frequency portion 142 form cooperatively a high-frequency radiator 14.

The first feeding portion 121 is connected with a low-frequency radiator 15 located at a same side with respect to the first feeding portion 121 as the second high-frequency portion 142. The low-frequency radiator 15 facing the grounding portion 11 includes a first low-frequency portion 151 extending substantially perpendicularly from an end of the first feeding portion 121 adjacent to the first high-frequency portion 141, a second low-frequency portion 152 extending upwards from a distal end of the first low-frequency portion 151, and a third low-frequency portion 153 extending back to the first low-frequency portion 151 from a free end of the second low-frequency portion 152. The first low-frequency portion 151 is a rectangular shape. The second low-frequency portion 152 is disposed adjacent to a distal end of the second high-frequency portion 142. The third low-frequency portion 153 has a top edge substantially flush with a top edge of the grounding portion 11. A distal end of the third low-frequency portion 153 is substantially arranged at a same plane with an edge of the grounding portion 11 away from the feeding portion 12.

When the dual-band antenna 1 mounted in the notebook computer is operated at wireless communication, a current flows from the feeding portion 12 to the high-frequency radiator 14 to generate an electrical resonance of a frequency band covering between 4.9 GHz and 5.8 GHz, according to the standard of the IEEE 802.11a. While the current flows from the feeding portion 12 to the low-frequency radiator 15 to generate an electrical resonance of a frequency band covering between 2.4 GHz and 2.5 GHz, according to the standard of the IEEE802.11b. Furthermore, the second low-frequency portion 152 can prevent the secondary resonance of the low-frequency radiator 15 from interfering with the mode effect of the high-frequency radiator 14, which will improve the gain of the dual-band antenna 1.

As described above, the high-frequency radiator 14 and the low-frequency radiator 15 can cover the frequency band ranging from 4.9 GHz to 5.8 GHz and the frequency band ranging from 2.4 GHz to 2.5 GHz, respectively. Meanwhile, the grounding portion 11 faces the low-frequency radiator 15, and the feeding portion 12 and the high-frequency radiator 14 are substantially disposed between the grounding portion 11 and the low-frequency radiator 15. Consequently, the dual-band antenna 1 occupies a small space of the notebook computer and can be used widely to meet users' demands.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A dual-band antenna, comprising:

a feeding portion including a first feeding portion and a second feeding portion extending substantially perpendicularly from a top edge of the first feeding portion;

a high-frequency radiator spaced away from the second feeding portion including a first high-frequency portion extending upwards from the top edge of the first feeding portion, and a second high-frequency portion extending substantially perpendicularly from a top of the first high-frequency portion and located at a same side with respect to the first feeding portion as the second feeding portion;

a low-frequency radiator located at a same side with respect to the first feeding portion as the second high-frequency portion, the low-frequency radiator including a first low-frequency portion extending substantially perpendicularly from an end of the first feeding portion adjacent to the high-frequency radiator, a second low-frequency portion extending upwards from the first low-frequency portion, and a third low-frequency portion extending away from the first low-frequency portion and perpendicular to the second low-frequency portion;

a grounding portion facing the low-frequency radiator for substantially locating the feeding portion and the high-frequency radiator therebetween; and a connecting portion connecting the grounding portion and the feeding portion.

2. The dual-band antenna as claimed in claim 1, wherein the connecting portion is connected with an end of a bottom edge of the grounding portion away from the first feeding portion, and a middle portion of a bottom edge of the first feeding portion, with a sharp angle formed between the grounding portion and the connecting portion.

3. The dual-band antenna as claimed in claim 1, wherein the feeding portion is disposed substantially perpendicular to the grounding portion, the first feeding portion is substantially flush with one edge of the grounding portion away from the connecting portion.

4. The dual-band antenna as claimed in claim 1, wherein bottom edges of the grounding portion and the bottom edge of the first feeding portion are substantially at a same plane.

5. The dual-band antenna as claimed in claim 1, wherein top edges of the grounding portion and the top edge of the third low-frequency portion are substantially at a same plane.

6. The dual-band antenna as claimed in claim 1, wherein the top edge of the grounding portion and top edge of the third low-frequency portion away from the first feeding portion are substantially at a same plane.

* * * * *